US010525307B1

(12) United States Patent
Maresh

(10) Patent No.: US 10,525,307 B1
(45) **Date of Patent: *Jan. 7, 2020**

(54) SWIM FIN

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/125,696

(22) Filed: Sep. 8, 2018

Related U.S. Application Data

(63) Continuation of application No. 15/609,004, filed on May 30, 2017, now Pat. No. 10,071,288, which is a continuation-in-part of application No. 15/098,302, filed on Apr. 13, 2016, now Pat. No. 9,764,192.

(60) Provisional application No. 62/392,390, filed on May 28, 2016, provisional application No. 62/178,546, filed on Apr. 13, 2015, provisional application No. 62/231,259, filed on Jun. 29, 2015, provisional application No. 62/231,696, filed on Jul. 13, 2015, provisional application No. 62/282,187, filed on Jul. 27, 2015.

(51) Int. Cl.
*A63B 31/11* (2006.01)

(52) U.S. Cl.
CPC ..... *A63B 31/11* (2013.01); *A63B 2031/115* (2013.01); *A63B 2244/20* (2013.01)

(58) Field of Classification Search
CPC ..... A63B 31/11; A63B 2031/115; A63B 2244/02; A63B 2244/20
See application file for complete search history.

(56) References Cited

U.S. PATENT DOCUMENTS

| | | | | |
|---|---|---|---|---|
| 5,567,115 | A * | 10/1996 | Carbone | F16M 11/40 362/198 |
| 7,281,963 | B1 * | 10/2007 | Feng | A63B 31/11 441/64 |
| 7,779,492 | B2 * | 8/2010 | Mangano | A47C 7/383 5/417 |
| 9,764,192 | B1 * | 9/2017 | Maresh | A63B 31/11 |
| 10,071,288 | B1 * | 9/2018 | Maresh | A63B 31/11 |
| 2010/0273371 | A1 * | 10/2010 | Hsu | A63B 31/11 441/64 |
| 2011/0263945 | A1 * | 10/2011 | Peterson | A61B 17/0218 600/213 |

* cited by examiner

*Primary Examiner* — Stephen P Avila
(74) *Attorney, Agent, or Firm* — Nick A Nichols, Jr.

(57) ABSTRACT

A swim fin may include a foot pocket configured to receive a foot of a swimmer and a fin blade extending from the foot pocket. The fin blade may be relatively stiff and flex about a hinge region proximate the foot pocket. Fin rails may extend along the lateral edges of the fin blade. The fin rails may include a fin spine comprising a plurality of fin spine segments joined in linear configuration. The swim fin may be configured to provide a swim fin with predetermined hydrodynamic characteristics. The swim fin may flex within a maximum angle of attack that may be variable and dynamically changed, within the predetermined maximum attack angle range, as a function of the kicking force generated by a swimmer during a kicking cycle.

9 Claims, 6 Drawing Sheets

SWIM FIN

CROSS-REFERENCE TO RELATED APPLICATION

This is a continuation application of U.S. non-provisional patent application Ser. No. 15/609,004, filed May 30, 2017, U.S. Pat. No. 10,071,288, which claims the benefit of U.S. Provisional Application Ser. No. 62/392,390, filed May 28, 2016, and which is a continuation-in-part of Non-Provisional application Ser. No. 15/098,302, filed Apr. 13, 2016, which claims the benefit of U.S. Provisional Application Ser. No. 62/178,546, filed Apr. 13, 2015, U.S. Provisional Application Ser. No. 62/231,259, filed Jun. 29, 2015, U.S. Provisional Application Ser. No. 62/231,696, filed Jul. 13, 2015, and U.S. Provisional Application Ser. No. 62/282,187, filed Jul. 27, 2015, which applications are herein incorporated by reference in their entirety.

BACKGROUND

The present invention relates to hydrofoils of the type used for propulsion in a fluid medium, and more particularly to swim fins.

Swim fins are used by swimmers, body surfers, divers and others in water to improve propulsion speed and water agility. Swim fin designs that combine a foot pocket with side rails and a propulsion blade are commercially available. The objective of a swim fin design is to provide maximum propulsion and agility while minimizing the work expended by the swimmer. This may be accomplished by optimizing the angle of attack of the fin blade during the up and down strokes of the swimmer's kick propelling him through the water. Typical swim fins currently available are either too rigid or too flexible for a given use, or have contours or profiles that result in inefficient hydrodynamics where water spills over the sides of the fin blade, or generate fluid vortices that may negate lift or propulsive forces resulting in a decrease in swimming efficiency with a corresponding increase in swimmer fatigue. For optimum propulsion, it is desired for water flow to be laminar and essentially free of excess turbulence.

The "angle of attack" of a fin blade may be defined as the angle between the line of horizontal movement of the swimmer's body through the water and the lengthwise alignment of the fin blade relative to the line of horizontal movement. Swim fin performance may be optimized for various modes of use. For example, available swim fins may be designed for low, moderate or aggressive kicking. For recreational or relaxed use, the swim fin may be constructed of flexible material to provide a low angle of attack for efficient low thrust operation. For aggressive kicking, the swim fin may be constructed of stiff material to provide a high angle of attack for efficient high thrust operation. A proper angle of attack may optimize the conversion of kicking energy of the swimmer to thrust or propulsion through the water. Aggressive and nonaggressive modes of use generally required different fin designs and/or different fin material durometers because optimum fin performance for each mode requires mutually exclusive design parameters. During nonaggressive use a highly flexible fin blade may provide efficient low thrust operation, whereas during aggressive use a rigid fin blade may provide efficient high thrust operation. Other known swim fin designs provide deformable regions permitting the fin blade to flex about a transverse axis.

SUMMARY

A swim fin may include a foot pocket configured to receive a foot of a swimmer and a fin blade extending from the foot pocket. The fin blade may be relatively stiff and flex about a hinge region proximate the foot pocket. Fin rails may extend along the lateral edges of the fin blade. The fin rails may include a fin spine comprising a plurality of fin spine segments in linear configuration. The fin spine may be configured to provide a swim fin with predetermined hydrodynamic characteristics. The swim fin may flex within a maximum angle of attack that may be variable and dynamically changed, within a predetermined maximum attack angle range, as a function of the kicking force generated by a swimmer during a kicking cycle.

Another aspect of the swim fin may include separately assembling the fin spine and embedding the fin spine in the fin rails during the molding process or securing the fin spine in a longitudinal cavity formed in the fin rails. A fin spine removal tool may be provided to facilitate removal of a fin spine from a swim fin.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
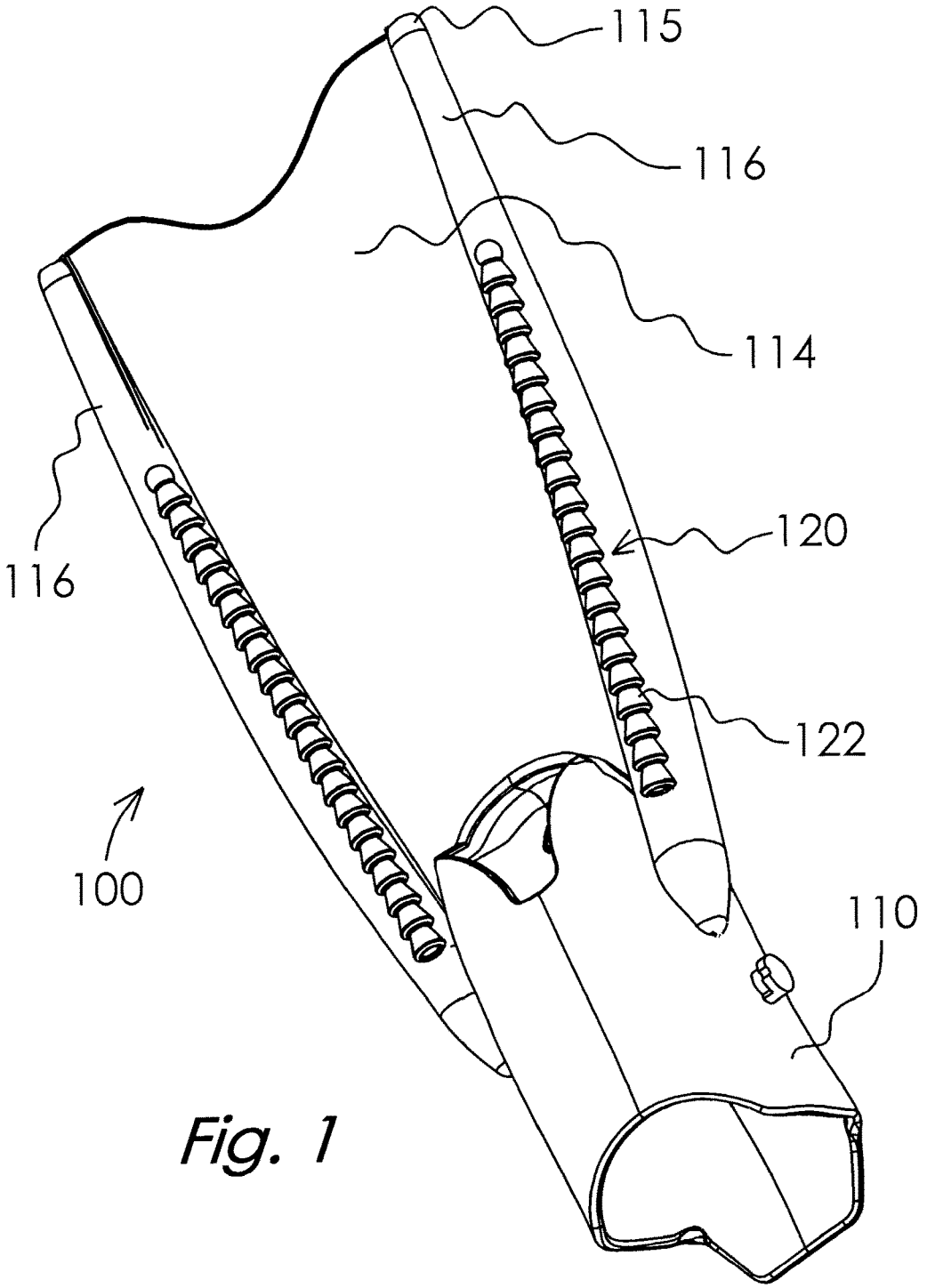
FIG. 1 is a perspective view of a swim fin depicting the fin spines in phantom.

Referring first to FIG. 1, a swim is generally identified by the reference numeral 100. The swim fin 100 may be molded or otherwise fabricated in a manner known in the art. The swim fin 100 may be formed of flexible materials, such as rubber, thermoplastic rubber and/or other synthetic material, and/or a composite of materials including carbon fiber. The swim fin 100 may include a full boot or shoe for receiving the foot of a swimmer or an open foot pocket 110, shown in FIG. 1. A heel strap 112, shown in FIG. 2, may be provided to secure the foot of a swimmer in the foot pocket 110. A fin blade 114 may extend from the foot pocket 110. The fin blade 114 may include a substantially planar surface for channeling water flow across the swim fin 100. Fin rails 116 may extend along the lateral edges of the fin blade 114.

Figure 2:
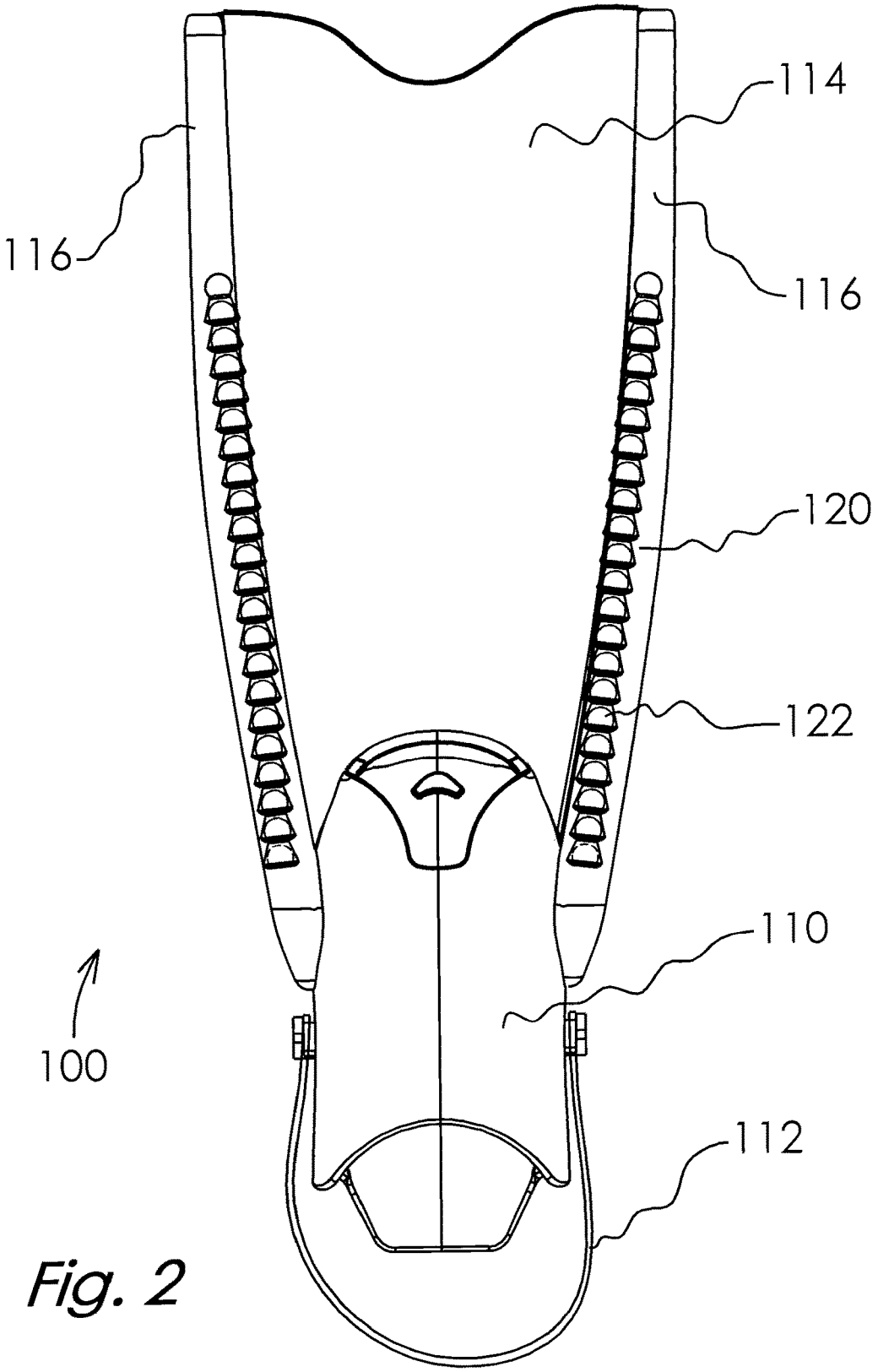
FIG. 2 is a partially broken away top plan view of the swim fin shown in FIG. 1.

The fin blade 114 may be relatively stiff. During a kick stroke, the fin blade 114 may flex about a transverse hinge region 118 of the swim fin 100. Flexing of the fin blade 114 may be limited by a fin spine 120 formed by a plurality of articulated fin spine segments 122 embedded in the fin rails 116 in a serial or linear configuration to form the fin spine 120. The length of the fin spine 120 may be a predetermined value. The shape of the fin spine segments 122 is not limited to a particular shape but may, for example, be cubically shaped, chevron shaped, cylindrically shaped, and/or polygon shaped. As shown in FIG. 2, the fin spine segments 122 may be arranged in a serial or linear manner and then molded in place within the fin rails 116 during fabrication of the swim fin 100. The size and shape of the fin spine segments 122 may be predetermined to provide the desired hydrodynamic characteristics for the swim fin 100. The fin spine segments 122 may be molded from plastic, for example but not by limitation, polycarbonate, polyetheretherketone (PEEK) and the like. Alternatively, the fin spine segments 122 may be formed of metal.

Continuing with FIG. 1, the design of the swim fin 100 may be optimized for a predetermined maximum angle of attack of the fin blade 114. For example, the fin spine segments 122 may be symmetrically shaped so that the fin rails 116 and fin blade 114 flex at equal angles from a relaxed state of the swim fin 100. Alternatively, the shape of the fin spine segments 122 may be unsymmetrical so that the predetermined angle of attack produces high thrust during a downward kick stroke, and minimal thrust during an upward return kick stroke. Other factors that may be considered to optimize the swim fin design, may include whether to align the neutral axis of the fin blade 114 with the neutral axis of the fin rails 116, or whether to offset one neutral axis from the other. In this manner, the progression of the fin blade 114 angle of attack profile as a function of thrust may be a dynamic variable up to the predetermined attack of angle of the fin blade 114.

Figure 4:
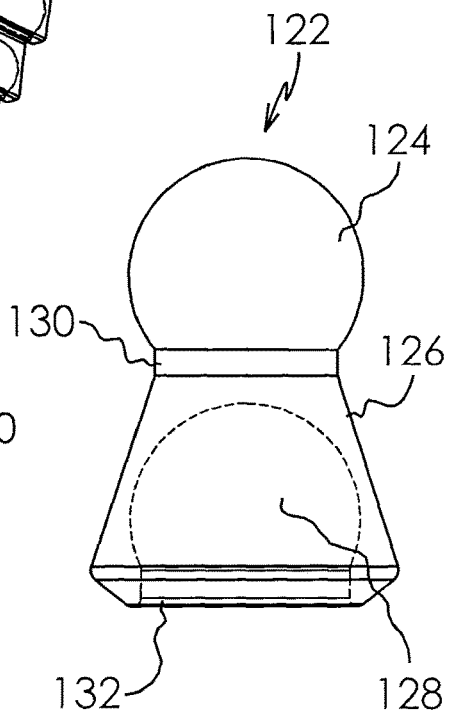
FIG. 4 is a partial section view of a fin spine segment of the fin spine shown in FIG. 3A.

Referring now to FIG. 4, a fin spine segment 122 is shown in partial section view. The fin spine segment 122 may include an upper portion 124 and a lower portion 126. The upper portion 122 may define a substantially semi-spherical or dome-like shape. The lower portion 126 may include a socket or cavity 128 configured to receive the upper portion 124 of the fin spine segment 122. The lower portion 126 of the fin spine segment 122 may terminate at a circumferential transition surface 130 joining the upper portion 124 of the fin spine segment 122 to the lower portion 126. The socket 128 of the lower portion 126 may be circumscribed by a tapered surface 132.

Figure 3A:
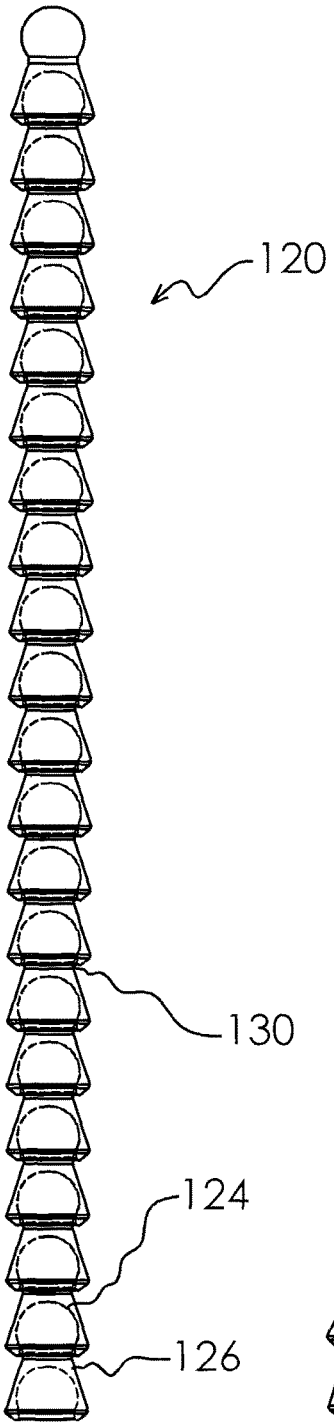
FIG. 3A is a plan view of a fin spine of the swim tin shown in FIG. 1 illustrating the interface between fin spine segments in a linear configuration.
Figure 3B:
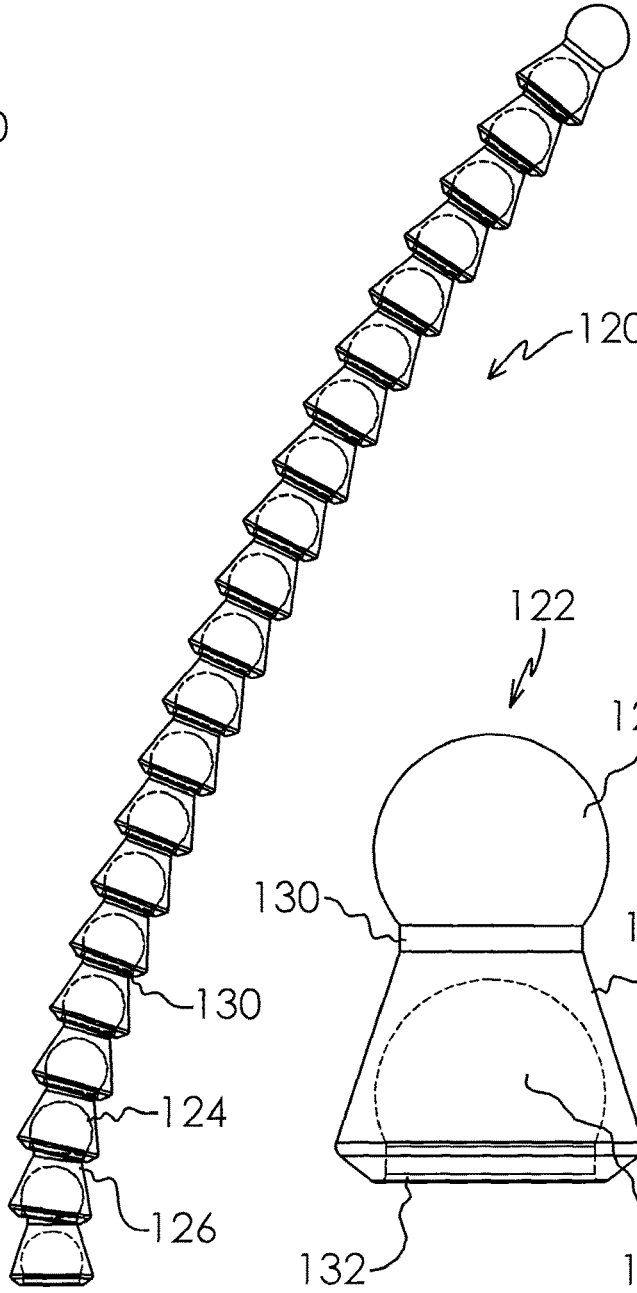
FIG. 3B is a plan view of the fin spine shown in FIG. 3A illustrating the interface between fin spine segments in a non-linear configuration.

Referring now to FIGS. 3A and 3B, a plurality of fin spine segments 122 connected in series form the fin spine 120. FIGS. 3A and 3B illustrate the interface between adjacent fin spine segments 122. The upper portion 124 of a fin spine segment 122 may be received in the socket 128 of the next fin spine segment 122 to form a fin spine 120 of a desired length. The dome and socket interface permit adjoining fin spine members 122 to move in multiple planes relative to one another. The fin spine segments 122 may rotate about a longitudinal center axis of the fin spine 120 and angularly deflect relative to one another, simultaneously, where for example, the fin spine 120 may deflect in vertical and lateral directions during a kicking stroke to form a "scoop" shape as known in the art.

The range of articulated movement of the fin spine 120 may be limited by the maximum relative movement permitted at the interface between the transition surface 130 and tapered surface 132 of adjoining fin spine segments 122, depicted in FIG. 3B. In the relaxed or non-kicking position, the fin spine 120 may be considered to extend in a straight or linear orientation. Leg movement during the kicking stroke of a swimmer forces the swim fin 100 to flex to a maximum deflection from the linear orientation for a predetermined curve profile a fin blade 114.

The swim fin 100 may provide an optimum angle of attack for a range of kicking strokes of a fin blade 114. The overall flexibility of the swim fin 100 may permit a low angle of attack of the fin blade 114 during relaxed or moderate kicking, while during hard aggressive kicking the fin blade 114 may bend at a greater angle of attack, for example forty-five (45°) degrees from a relaxed state, as an increase of water flow across the swim fin 100 exerts increased fluid pressure against the surface of the fin blade 114. The angle of attack curve profile of the fin blade 114 may be asymptotically limited by the fin spine 120 to the maximum predetermined angle of attack to ensure efficient thrust propulsion with maximum laminar water flow across the swim fin 100.

The flexibility potential of the swim fin 100, with predetermined maximum fin blade attack angles, may facilitate a swimmer's rapid change of direction, particularly when agility is required, as for example, when a swimmer must contort his body during critical water diving or swimming events. Also, during moderate kicking, the swimmer may experience a reduction in ankle, foot, and Achilles tendon pain.

The torsional stiffness of the fin blade 114 may be generally balanced at left and right sides of the fin blade 114 due to the bending limit constraints imposed on the fin rails 116 by the fin spine 120. Efficiency may be gained by essentially eliminating swim fin twist as the swimmer kicks. In this manner, water flow over the surface of the fin blade 114 without spilling over may be achieved and the swim fin 100 may track straighter without twisting and steering by the swimmer, thus conserving energy. The swim fin 100 may thus provide a highly stabilized and straight-line kicking experience, while enabling the swimmer to maneuver as desired.

The range of articulated movement of the fin spine 120 may be limited by the maximum relative movement permitted at the interface between the transition surface 130 and tapered surface 132 of adjoining fin spine segments 122, depicted in FIG. 3B. In the relaxed or non-kicking position, the fin spine 120 may be considered to extend in a straight or linear orientation. Leg movement during the kicking stroke of a swimmer forces the swim fin 100 to flex to a maximum deflection from the linear orientation for a predetermined curve profile a tin blade 114.

Referring next to FIGS. 5A-5B and 6A-6B, a second embodiment of a swim fin spine generally identified by the reference numeral 220, is shown. The fin spine 220 is substantially similar to the fin spine 110 described above with the exception that the fin spine 220 may flex only in a single plane. The fin spine 220 may include a plurality of articulated fin spine segments 222. The fin spine segments 222 may include an upper portion 224 and a lower portion 226. The upper portion 224 may define a substantially semi-spherical shaped surface 225 and further include oppositely facing substantially planar surfaces 223 defining substantially vertical planes spaced from and parallel to the vertical rotational axis of the fin spine segment 222. The lower portion 226 may include a socket or cavity 228 configured to receive the upper portion 224 of the fin spine segment 222. The socket 228 may be defined by spaced apart sidewalls 229, 231 in facing relationship to one another and a semi-spherical top wall 233. The sidewalls 229, 231 and top wall 233 may be configured for mating engagement with the planar surface 223 and surface 225 of the upper portion 224, respectively, of the fin spine segment 222.

Figure 5A:
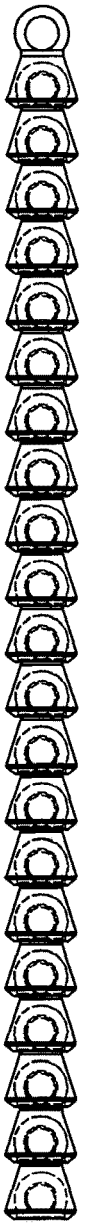
FIG. 5A is a plan view of an alternate embodiment of a fin spine depicting the interface between fin spine segments in a linear configuration.
Figure 5B:
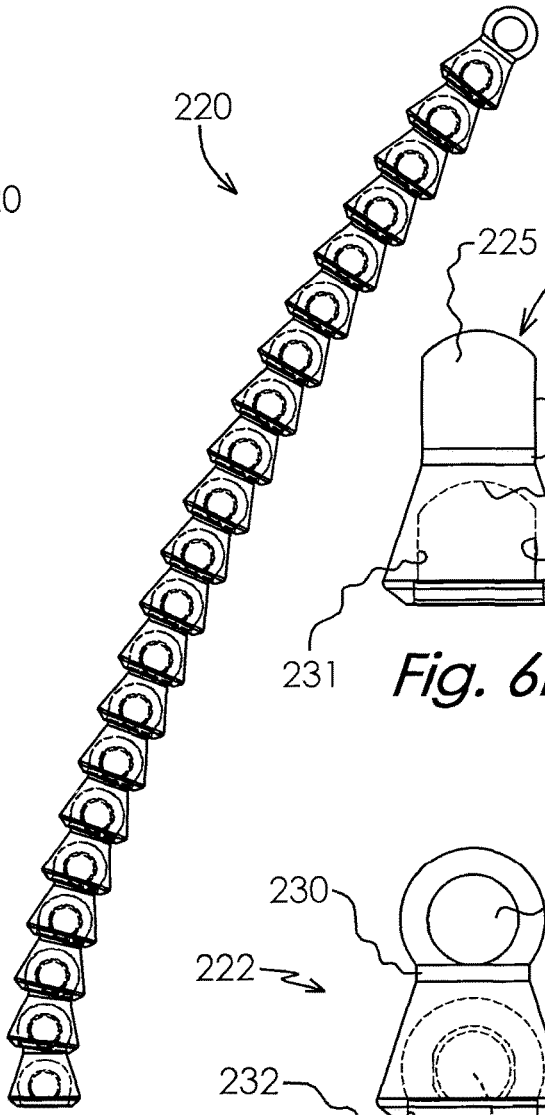
FIG. 5B is a plan view of the fin spine shown in FIG. 5A depicting the interface between fin spine segments in a non-linear configuration.
Figure 6B:
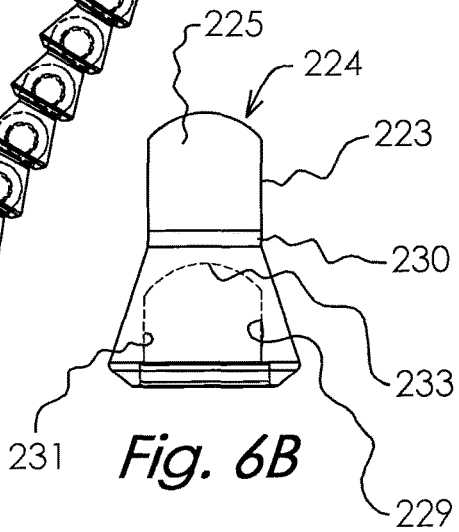
FIG. 6B is a side view of the fin spine segment shown in FIG. 6A taken from the right of FIG. 6A.
Figure 6A:
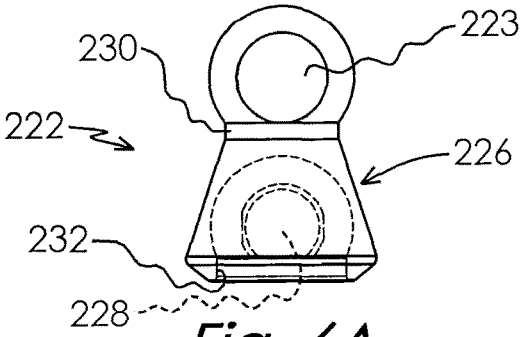
FIG. 6A is a side view of a fin spine segment of the fin spine shown in FIG. 5A.
Figure 7A:
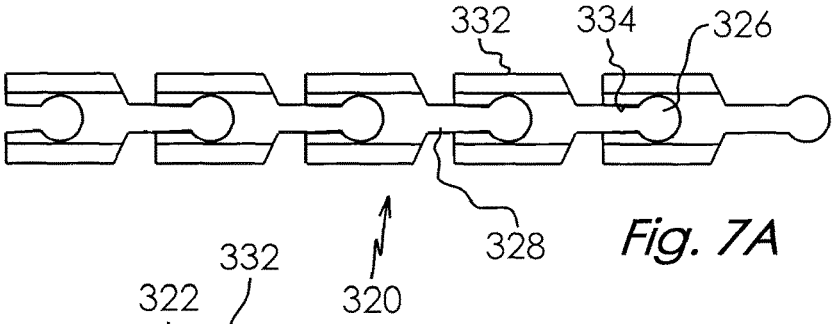
FIG. 7A is a side view of an alternate embodiment of a fin spine depicting the interface between fin spine segments in a linear configuration.
Figure 7B:
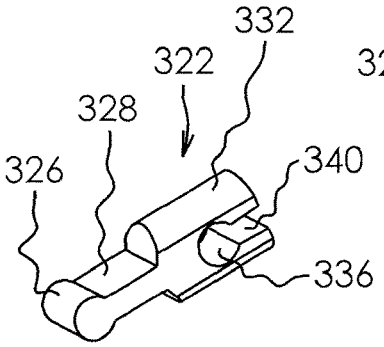
FIG. 7B is a top perspective view of a fin spine segment of the swim fin shown in FIG. 7A.
Figure 7C:
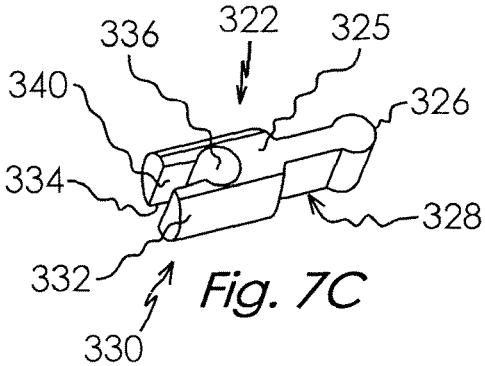
FIG. 7C is a side perspective view of a fin spine segment of the swim fin shown in FIG. 7A.

Referring now to FIGS. 5A and 51, a plurality of fin spine segments 222 connected in series form the fin spine 220. FIGS. 5A and 5B illustrate the interface between adjacent fin spine segments 222. The upper portion 224 of a fin spine segment 222 may be received in the socket 228 of an adjoining fin spine segment 222 to form a fin spine 220 of a desired length. The lower portion 226 of the fin spine segment 222 may terminate at a circumferential transition surface 230 joining the upper portion 224 of the fin spine segment 222 to the lower portion 226. The socket 228 may be circumscribed by a tapered surface 232. The dome and socket interface of the sidewalls 229, 231 and wall 233 limit flexing of the fin spine 220 to a single vertical plane extending through the longitudinal axis of the fin spine 220. The fin spine 220 may, however, rotate about the longitudinal axis of the cavity 115 of the fin rails 116.

Referring next to FIGS. 7A-7E and FIGS. 8-10, a third embodiment of a swim fin spine generally identified by the reference numeral 320, is shown. The fin spine 320 is substantially similar to the fin spines 120, 220 described above with the exception that fin spine 320 may flex in only one plane and may not rotate about the longitudinal axis of the cavity 115 of the fin rails 116.

The fin spine 320 may include a plurality of articulated fin spine segments 322 connected in series to form a fin spine 320 of a predetermined length. A fin spine segment 322 may be generally described as including a pair of oppositely facing flat or planar surfaces 325, a transverse proximal head portion 326 defining a substantially cylindrical profile, an intermediate stem portion 328, and a yoke-shaped distal portion 330. The distal portion 330 may include a pair of spaced apart prongs 332 defining a gap 334 therebetween opening into a transverse cylindrically shaped socket or cavity 336. The socket 336 may be sized and shaped to receive the head portion 326. The distal portion 330 may include an arcuate or curved surface disposed between the oppositely facing planar surfaces 325. The gap 334 between the spaced and facing planar inner walls 340 of the prongs 330 provide engagement or stop shoulders limiting rotation of a fin spine segment 322 relative to an adjoining fin spine segment 322.

Figure 8:
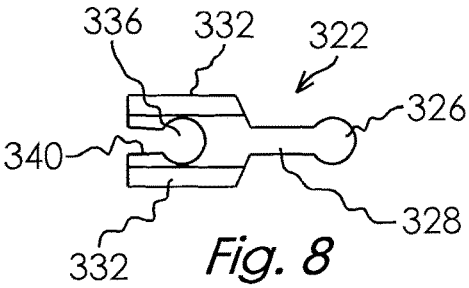
FIG. 8 is a side view of an alternate embodiment of a fin spine segment.
Figure 7D:
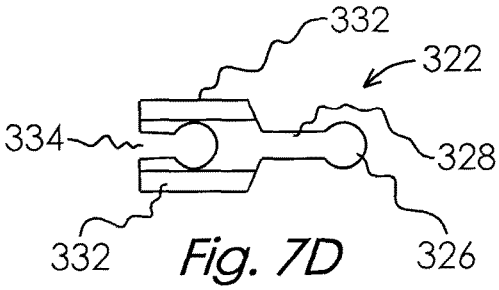
FIG. 7D is a side view of a fin spine segment of the swim fin shown in FIG. 7A.
Figure 7E:
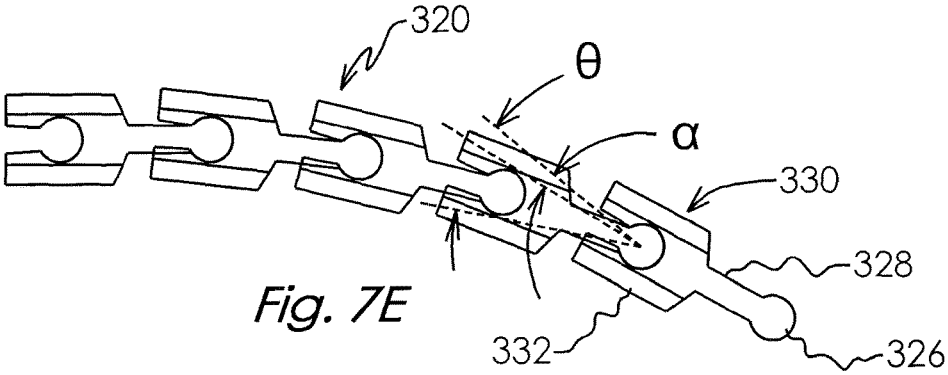
FIG. 7E is a side view of the swim fin shown in FIG. 7A depicting the interface between fin spine segments in a non-linear configuration.

The stop walls 340 of the prongs 330 may be sufficiently spaced apart so that an adjoining fin spine segment 322 may rotate an angle $\alpha$ relative to the longitudinal axis of the fin spine segment 322, more clearly shown in FIG. 7E. The delta angle may be about two (2°) degrees and a theta angle ($\theta$) between the stop walls 340 of about four (4°) degrees. Alternatively, one of the stop walls 340 may extend at an angle, as shown in FIG. 8, so that the fin spine 320 may flex in only one direction from the straight or linear configuration.

Figure 9A:
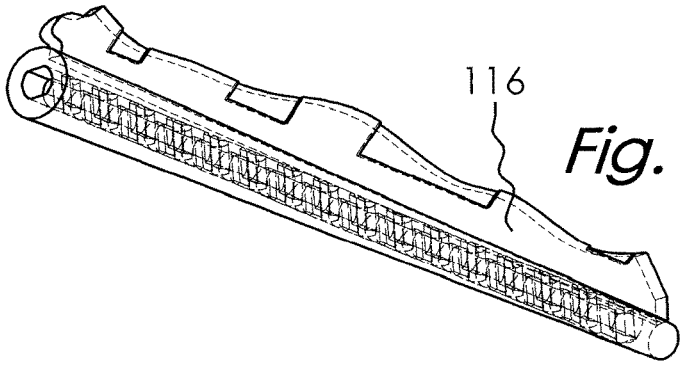
FIG. 9A is a partial fragmentary perspective view of a swim fin depicting the fin spine in phantom.
Figure 9B:
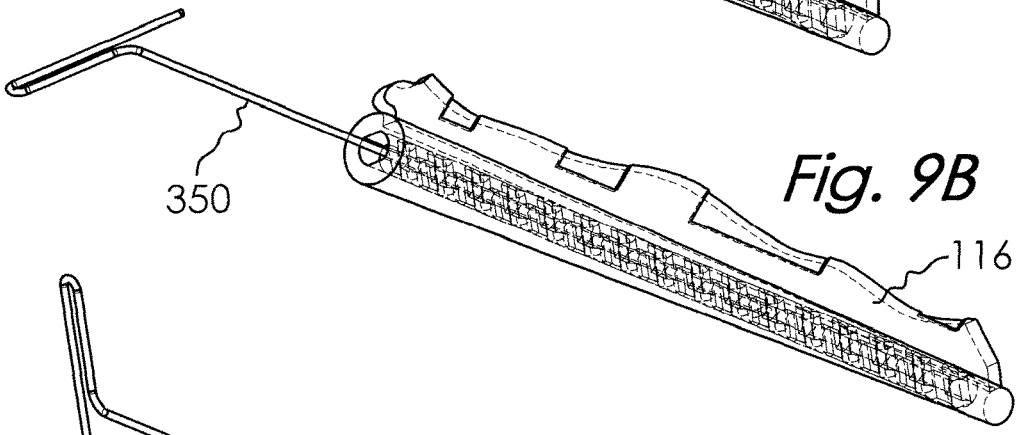
FIG. 9*b* is a partial fragmentary perspective view of the swim fin shown in FIG. 9A depicting a fin spine removal tool in position to remove a fin spine.
Figure 9C:
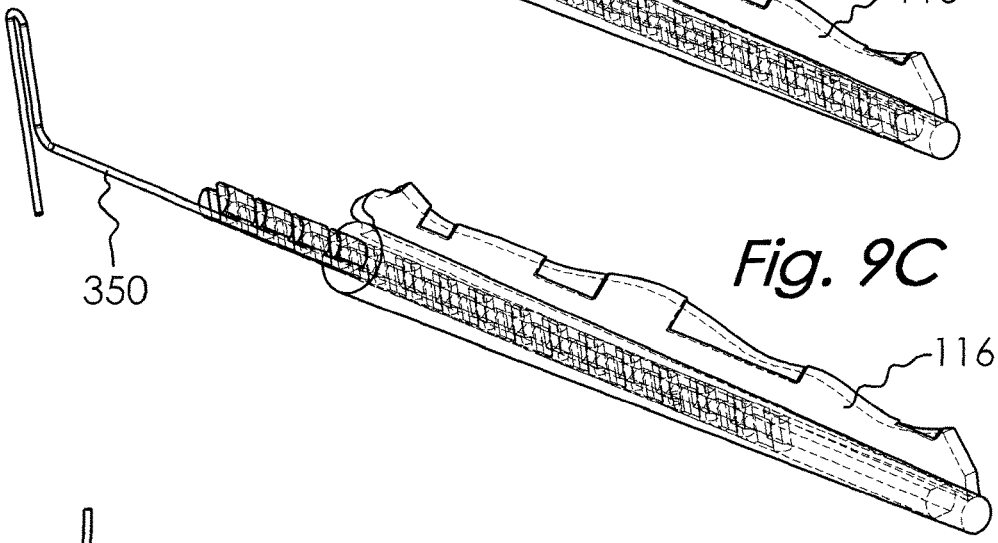
FIG. 9C is a partial fragmentary perspective view depicting removal of a fin spine from the swim fin shown in FIG. 9A.
Figure 10:
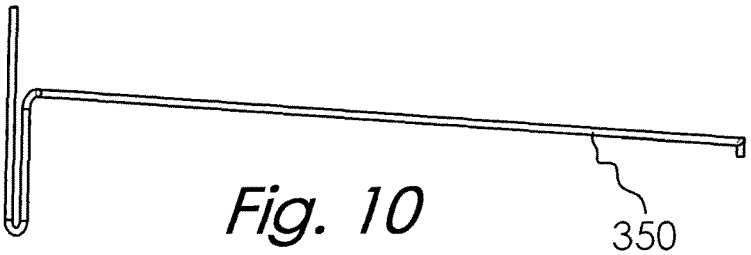
FIG. 10 is a side view of a fin spine removal tool.

A spine removal tool 350, shown in FIG. 10, may provide a convenient means for removing a fin spine, such as fin spine 320 shown in FIGS. 9A-9C, from the fin rails 116 if a fin spine is broken and/or to replace a fin spine with anther fin spine having different flex characteristics. For example, a highly flexible fin spine may be selected to improve maneuverability and also reduce strain on a swimmer's legs, feet and ankles while accepting less thrust with a high delta angle. Conversely, swimming in current, carrying heavy loads, or situations requiring maximum thrust, a fin spine having a relatively low delta angle may be selected. In instances where use of different fin spines may not be necessary, the fin spine may be molded permanently in within a fin rail and/or within the fin blade.

While preferred embodiments of a swim fin have been shown and described, other and further embodiments may be devised without departing from the basic scope thereof, and the scope thereof is determined by the claims which follow.

The invention claimed is:

1. A swim fin comprising:

a) a flexible body including a foot pocket adapted to receive a foot of swimmer;

b) a substantially stiff fin blade extending outwardly from said foot pocket, said fin blade including a substantially flat surface between laterally spaced edges;

c) fin rails extending along said laterally spaced edges of said fin blade;

d) wherein each said fin rails include a plurality of fin spine segments in linear configuration defining a longitudinal fin spine; and e) each said plurality of fin spine segments includes a proximal portion, an intermediate portion and a distal portion, wherein said proximal portion defines a head portion and said distal portion defines a socket, said head portion adapted for receipt in said socket of an adjacent one of said plurality of fin spine segments, and said intermediate portion defines a transition surface between said proximal portion and said distal portion.

2. The swim fin of claim 1 wherein said plurality of fin spine segments are embedded in said fin rails.

3. The swim fin of claim 1 wherein each said fin rails includes a longitudinal cavity housing said fin spine.

4. The swim fin of claim 1 wherein said socket of each said plurality of fin spine segments includes an open end defined by a circumferential tapered surface.

5. The swim fin of claim 1 wherein said head portion of each said fin spine segments includes oppositely facing planar surfaces extending substantially parallel to a longitudinal center axis of said plurality of fin spine segments.

6. The swim fin of claim 5 wherein said socket of each said plurality of fin spine segments includes spaced apart substantially planar sidewalls and a substantially semi-spherical shaped surface disposed between said sidewalls transverse to the longitudinal center axis of said plurality of fin spine segments.

7. The swim fin of claim 1 wherein said distal portion of said plurality of fin spine segments includes a pair of prongs defining a gap therebetween opening into a cavity for receiving said head portion of a respective said plurality of fin spine segments.

8. The swim fin of claim 7 wherein one of said pair of prongs includes a planar surface substantially parallel to a longitudinal center axis of said fin spine and the other of said pair of prongs includes a planar surface extending at an angle relative to the longitudinal center axis of said fin spine.

9. The swim fin of claim 1 including a fin spine removal tool for removing a respective said fin spine from a respective said fin rails.

* * * * *